US005913498A

United States Patent [19]

Brown et al.

[11] Patent Number: 5,913,498

[45] Date of Patent: Jun. 22, 1999

[54] ADJUSTABLE CANTILEVER FOOT ASSEMBLY FOR FURNITURE

[75] Inventors: Thomas Alfred Brown; Dale Robert Marshall, both of Calgary, Canada

[73] Assignee: Smed International Inc., Calgary, Canada

[21] Appl. No.: 08/821,146

[22] Filed: Mar. 20, 1997

[51] Int. Cl.[6] ..... A47B 91/00

[52] U.S. Cl. ..... 248/188.8; 52/122; 248/188.2

[58] Field of Search ..... 248/188.8, 188.2, 248/188.4, 188.7, 188, 188.1; 52/239, 122

[56] References Cited

U.S. PATENT DOCUMENTS

| | | | |
|---|---|---|---|
| 3,040,391 | 6/1962 | Saunders | 20/19 |
| 3,844,079 | 10/1974 | Karrip | 52/221 |
| 4,135,690 | 1/1979 | Clarke et al. | 248/188.2 |
| 4,193,233 | 3/1980 | VandenHoek et al. | 52/122 |
| 4,229,917 | 10/1980 | Textoris et al. | 52/239 |
| 4,251,165 | 2/1981 | Forsen | 403/263 |
| 4,748,715 | 6/1988 | Rice | 16/19 |
| 4,858,865 | 8/1989 | Schrepfer | 248/188.2 |
| 5,690,303 | 11/1997 | Winters | 248/188.3 |

*Primary Examiner*—Ramon O. Ramirez
*Assistant Examiner*—Anita M. King

[57] ABSTRACT

An adjustable foot assembly for supporting and levelling furniture. A mounting bracket is attachable to a furniture leg and a cantilever member is pivotally mounted to the mounting bracket. The cantilever member is pivotable relative to said mounting bracket. A bolt extends between the mounting bracket and the cantilever member. Rotation of the bolt urges the cantilever member to rotate relative to the mounting bracket to relatively raise and lower a distal end of the cantilever member.

20 Claims, 2 Drawing Sheets

ADJUSTABLE CANTILEVER FOOT ASSEMBLY FOR FURNITURE

FIELD OF THE INVENTION

The present invention relates to an adjustable cantilever foot assembly. In particular, the present invention relates to an adjustable cantilever foot assembly for supporting and levelling modular furniture.

BACKGROUND OF THE INVENTION

Legs and supports for modular furniture systems typically comprise an extended foot with a pad for placement on a floor. The pad is mounted on a threaded shaft which is threadingly engaged with the foot. The pad thus has a range of adjustability limited to the length of threads which limits the height to the extended foot. When the floor is uneven, the pad may not have the range to evenly support the table. Further, the user must rotate the threaded shaft by awkwardly rotating a wrench just above the floor surface, occasionally resulting in skin damage to the user's hand.

U.S. Pat. No. 4,748,715 discloses an adjustable roller assembly for supporting and levelling appliances. This device secures to an appliance and has a roller which is mounted to a bracket which is pivotally connected to a stationery base frame. A horizontally disposed bolt threadably engages a nut mounted in the bracket. Rotation of the bolt urges the bracket to pivot relative to the base frame, thereby causing the roller to move up and down relative to the stationery base frame. The device has a very limited range and is thus not well suited for modular furniture applications.

SUMMARY OF THE INVENTION

It is an object of the present invention to overcome the disadvantages of the prior art by providing an adjustable cantilever foot assembly for supporting and levelling modular furniture systems and the like.

According to a first aspect of the present invention, there is provided an adjustable foot assembly for supporting and levelling furniture. A mounting bracket is attachable to a furniture leg and a cantilever member is pivotally mounted to the mounting bracket. The cantilever member is pivotable relative to the mounting bracket. A bolt extends between the mounting bracket and the cantilever member. Rotation of the bolt urges the cantilever member to rotate relative to the mounting bracket, causing a distal end to move.

According to another aspect of the invention, there is provided an adjustable foot assembly for supporting and levelling furniture. The foot assembly has a mounting bracket having an attachment for attaching the mounting bracket to a modular vertical support structure. The mounting bracket has a mounting plate having a bore. A cantilever member is pivotally mounted to the mounting bracket. The cantilever member has a near end and a distal end and the cantilever member pivots nearer the near end than the distal end. The near end has an aperture and a lug rotatably received with the aperture. The lug has a threaded transverse bore. A foot pad is mounted at the distal end of the cantilever member. A screw extends through the bore of the mounting plate and a nut is threadingly engaged thereon for lightly clamping the mounting plate with a screw head of the screw. The screw threadably engages the lug. Relative rotation of the screw pivots the cantilever member.

According to another aspect of the invention, there is provided furniture having an adjustable foot for levelling and supporting the furniture. The foot assembly has a mounting bracket having an attachment for attaching the mounting bracket to a modular vertical support structure. The mounting bracket has a mounting plate having a bore. A cantilever member is pivotally mounted to the mounting bracket. The cantilever member has a near end and a distal end and the cantilever member pivots nearer the near end than the distal end. The near end has an aperture and a lug rotatably received with the aperture. The lug has a threaded transverse bore. A foot pad is mounted at the distal end of the cantilever member. A screw extends through the bore of the mounting plate and a nut is threadingly engaged thereon for lightly clamping the mounting plate with a screw head of the screw. The screw threadably engages the lug. Relative rotation of the screw pivots the cantilever member.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
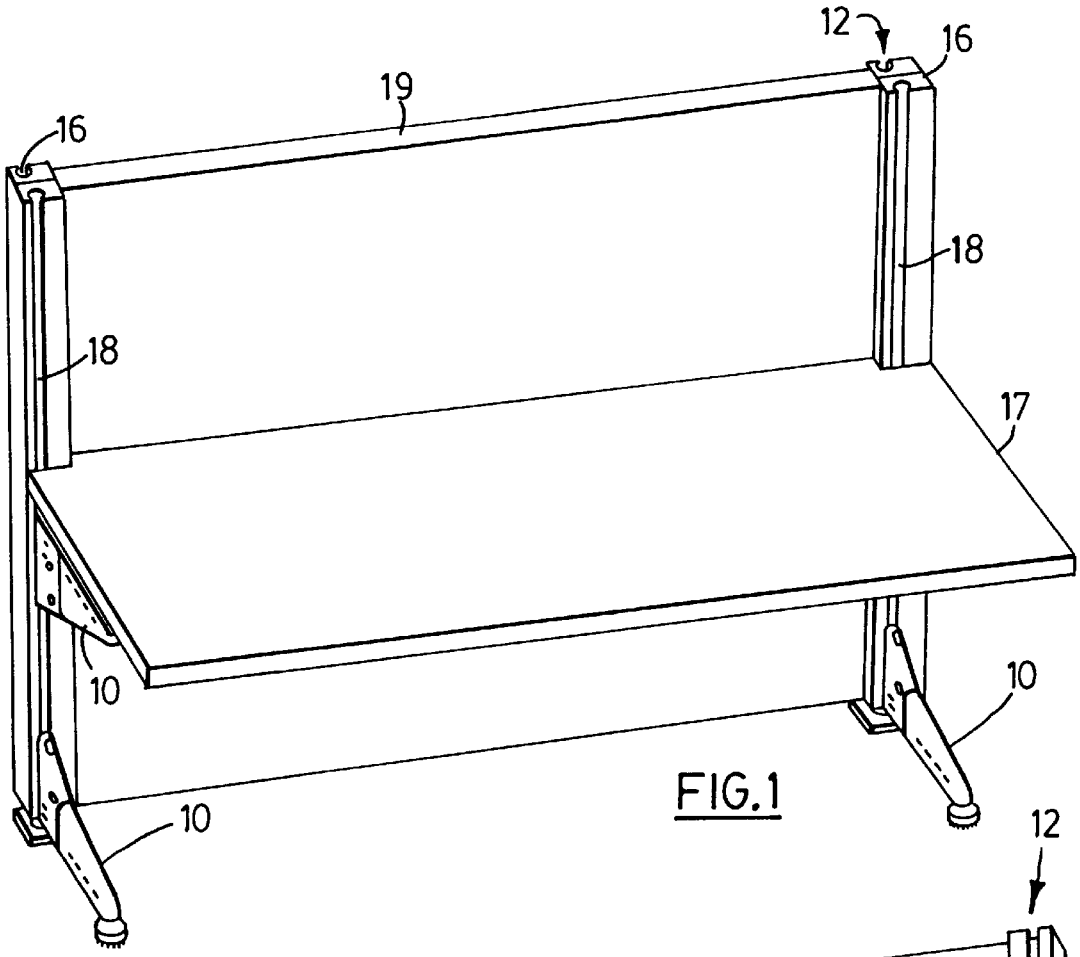
FIG. 1 is a perspective view of a modular desk incorporating the cantilever foot assembly of the present invention.
Figure 2:
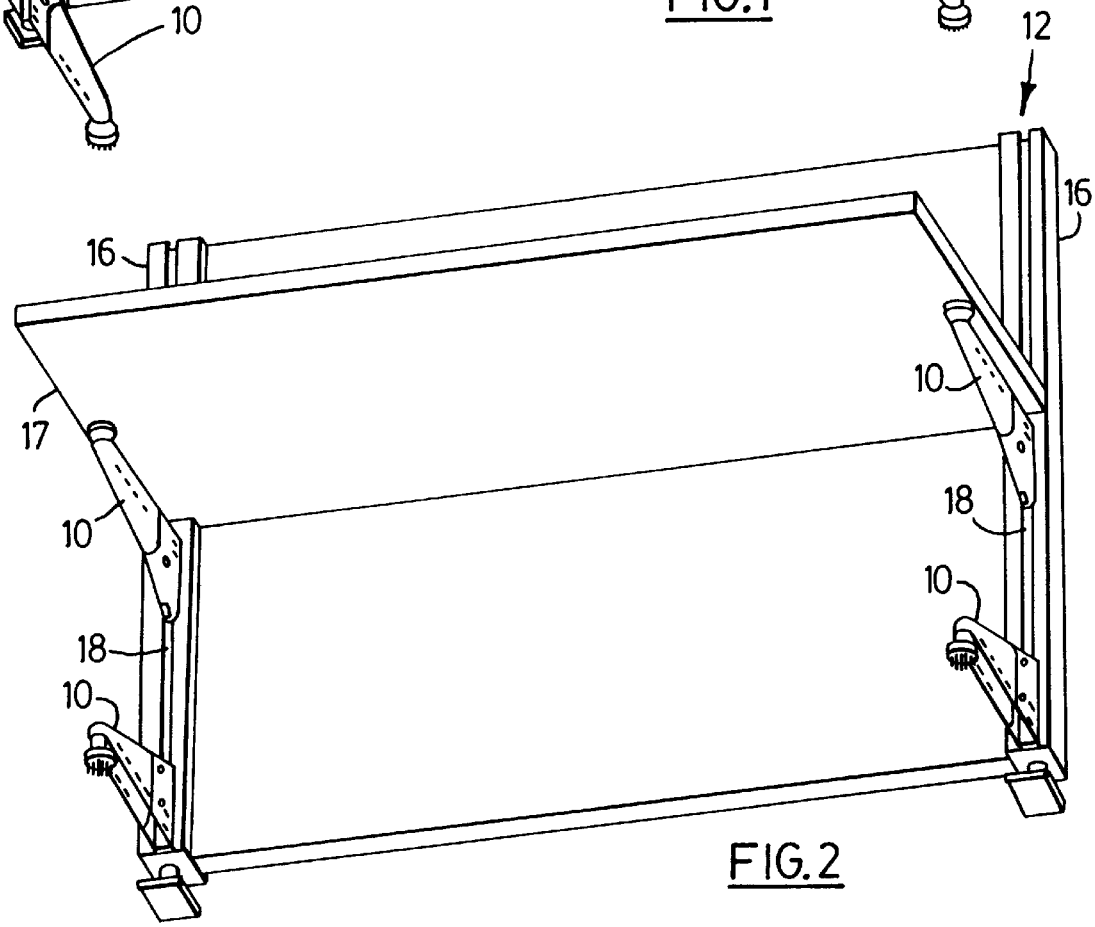
FIG. 2 is perspective view from an underside of a modular desk of FIG. 1 illustrating the foot assembly of the present invention inverted for supporting a desk top.

Referring to FIGS. 1 and 2, the adjustable cantilever leg assembly 10 of the present invention is shown attached to a frame or vertical support structure 12 of a modular desk, which preferably comprises a panel 14, vertical extrusions 16 and a desk 17. Extrusions 16 has a channel 18 on opposite faces thereof. Panel 14 and extrusions 16 are connected to each other and supported in a manner well known in the art.

Figure 3:
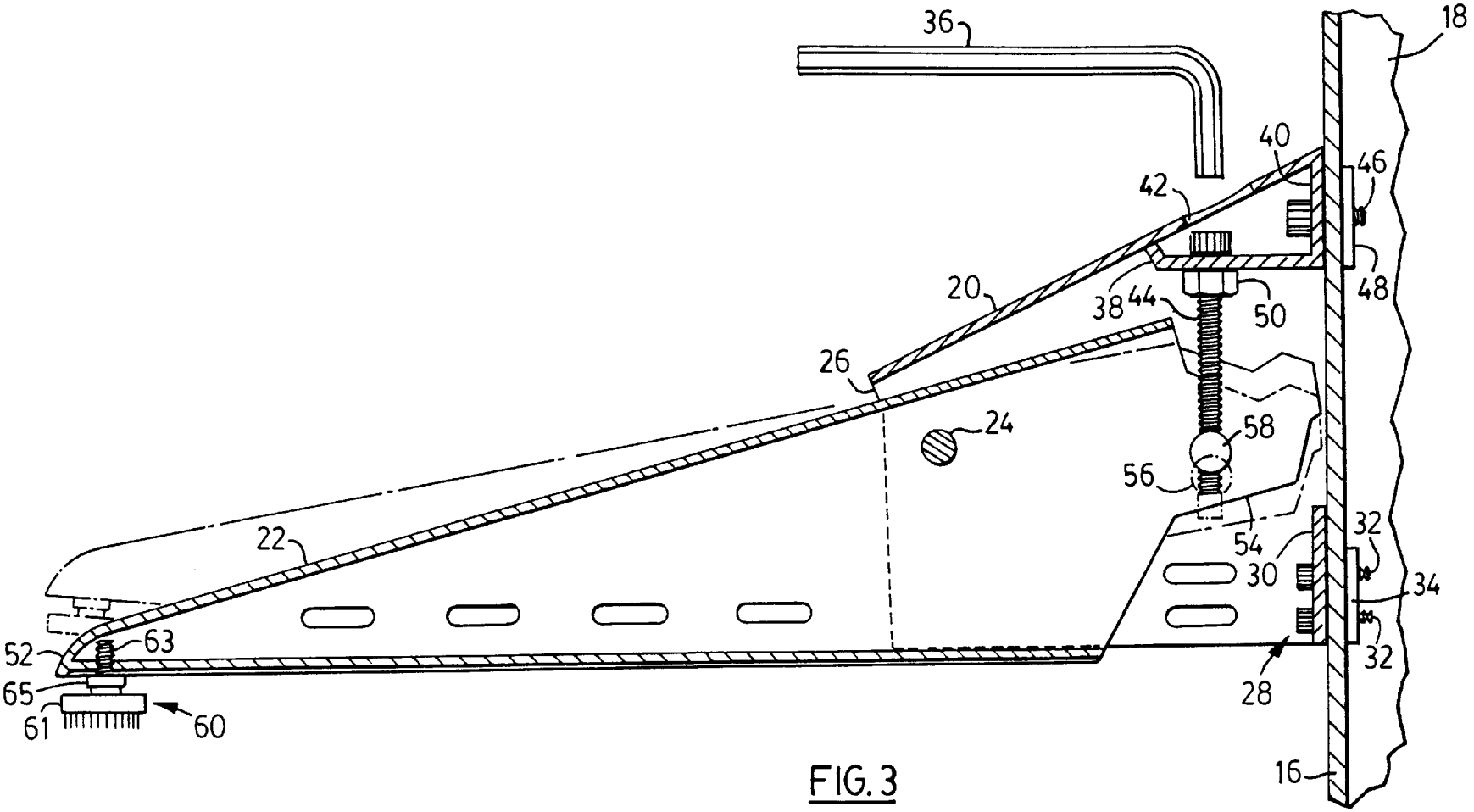
FIG. 3 is a cross sectional view through line 2—2 of the cantilevered foot assembly of FIG. 1.

Referring to FIG. 3, the adjustable cantilever leg 10 of the present invention is shown in more detail. Cantilever leg 10 generally comprises a mounting bracket 20 and a pivoting arm 22, which is pivotally connected to bracket 20 at pin 24.

Mounting bracket 20 is hollow having an inverted generally U shape with an open bottom, an open end 26 and a connection end 28. Connection end 28 has a bracket 30 which extends transversely at the lower edge of end 28. Bracket 30 has a pair of apertures for receiving bolts 32. Bolts 32 engage plate 34 for connecting mounting bracket 20 to extrusions 16. Plate 34 is sized to be inserted into channel 18, such that bolts 32 and plate 34 will clamp onto extrusions 16 while bolts extend into channel 18. Preferably, bolts 32 are hex bolts which cooperate with hex key or wrench 36.

Mounting bracket 20 has an internal plate 38, an end plate 40 and an access opening 42. End plate 40 extends transversely at the upper edge of end 28. Internal plate 38 extends from the end plate 40 to the inside face of the upper edge of mounting bracket 20. Internal plate 38 has an aperture for receiving bolt 44. End plate 40 has an aperture for receiving bolt 46. Bolt 46 engages plate 48 in a manner similar to engagement of bolts 32 and plate 34 for releasably attaching mounting bracket 20 to vertical extrusions 16. Access opening 42 on the upper edge of mounting bracket 20 is sized to receive hex key or wrench 36 so that the key 36 may rotate both screws or bolts 44 and 46. Nut 50 is threaded onto bolt 44. Although key 36 is illustrated as being sized to fit both bolts 32 and 44 and 46, it is understood that different sized keys and bolts could be used depending upon the stress load at the respective connecting points.

Pivoting arm 22 is generally elongate and is received in open end 26 of mounting bracket 20. Pivot pin 24 extends transversely through pivoting arm 22 and is connected to opposite inner faces of mounting bracket 20. The distal end 52 of pivoting arm 22 pivots relative to the mounting bracket 20. The proximate end 54 of pivoting arm 22 has an aperture 56 for receiving lug 58. Lug 58 has a transverse threaded bore for engaging bolt 44. Ends of the lug 58 extend through aperture 56. As bolt 44 rotates, lug 58 travels therealong for manipulating pivoting arm 22 as illustrated in phantom lines.

The distal end 52 of pivoting arm 22 has a foot pad 60 threadingly engaged thereto. The foot pad 60 has a base 61 which is mounted to a threaded shaft 63 by a ball and socket joint. Threaded shaft 63 has a fixed locking nut 65 for threading foot pad 60 into the pivoting arm 22.

In the preferred embodiment, the distance between the distal end 52 to pivot pin 24 versus the distance between the pivot pin 24 and aperture 56 is about 3:1.

In operation, mounting bracket 10 is mounted to vertical extrusions 16 and roughly positioned at the lower end thereof. Bolts 32 and 46 engage plates 34 and 48, respectively to connect the mounting bracket to the vertical extrusions 16. Hex key 36 is used to tighten the bolts 32 and 46 to fly retain the mounting bracket 20 thereon. Hex key 36 is then used to rotate bolt 44. Lug 58 is prevented from rotating with the bolt 44 causing relative travel of lug 58 therealong, which in turn causes pivoting arm 22 to rotate about pivot pin 24, urging distal end 52 to elevate or descend. This cooperative movement allows the user to relatively raise or lower the distal end 52 of cantilever leg 10 and foot pad 60, relative to the floor surface. The locking nut 50 is adjusted to be near tight to lightly clamp the mounting plate 38 with the head of the bolt 44, sufficiently light to allow rotatable movement of the bolt 44.

It is contemplated that the present invention may be incorporated as part of a conventional modular furniture system, such as for legs of modular computer tables, modular office desks, and modular shelving systems.

The present invention provides a wide range of height adjustment and levelling while maintaining a very low profile housing.

An additional advantage of the present invention is that the cantilever leg 10 may be inverted and mounted on the vertical extrusions 16 to act as a table top support for desk top 17. Desk top 17 could be used as a desk or may be sized to receive a computer keyboard. The cantilever leg 10 is manipulated in the same fashion as levelling. The cantilever leg 10 could support the desk top 17 level with the floor or at an inclined angle. The tilt of the desk top 17 is in the range of ±15°.

The above-described embodiments of the invention are intended to be examples of the present invention and alterations and modifications may be effected thereto, by those of skill in the art, without departing from the scope of the invention which is defined solely by the claims appended hereto.

We claim:

1. An adjustable foot assembly for supporting and levelling furniture, comprising:

a mounting bracket having attachment means for attaching the mounting bracket to a frame, a cantilever member pivotally mounted to said mounting bracket, said cantilever member having a first position and a second position in pivotal relation to said mounting bracket; and an adjustment means adjustably engaging the cantilever member and the, mounting bracket, the adjustment means, upon actuation, selectively positioning selectively positioning said cantilever member between said first position and said second position.

2. The adjustable foot assembly as claimed in claim 1 wherein said adjustment means comprises a screw threadably engaging said cantilever member whereby relative rotation of said screw pivots said cantilever member.

3. The adjustable foot assembly as claimed in claim 2 wherein said cantilever member is pivotably mounted to said mounting bracket at a pivot intermediate ends of said cantilever member.

4. The adjustable foot assembly as claimed in claim 3 wherein said cantilever member has a near end and a distal end and said intermediate pivot is nearer the near end than said distal end.

5. The adjustable foot assembly as claimed in claim 4 wherein said distal end has a foot pad.

6. The adjustable foot assembly as claimed in claim 5 wherein said mounting bracket has a mounting plate having a bore for receiving said screw and said screw has a nut threadingly engaged thereon for lightly clamping said mounting plate with a screw head of said screw.

7. The adjustable foot assembly as claimed in claim 6 wherein said cantilever member has receiving means for threadably and rotatably receiving a threaded end of said screw.

8. The adjustable foot assembly as claimed in claim 7 wherein said receiving means comprises an aperture extending parallel to a direction of said pivot, a lug rotatably received with said aperture, said lug having a threaded transverse bore threadably receiving said screw.

9. The adjustable foot assembly as claimed in claim 8 wherein said screw is mounted substantially tangential to the pivotal rotation of said cantilever member.

10. The adjustable foot assembly as claimed in claim 9 wherein said mounting bracket is hollow having an open end and said near end of said cantilever member is housed within said mounting bracket.

11. The adjustable foot assembly as claimed in claim 10 wherein said cantilever member has a length ratio of the distal end to pivot and the pivot to the near end of about 3:1.

12. The adjustable foot assembly as claimed in claim 11 wherein said foot pad has a pivoting base for compensating for a differences between relative angles between a support surface and said cantilever member.

13. An adjustable foot assembly for supporting and levelling furniture comprising:

a mounting bracket having attachment means for attaching the mounting bracket to a frame, said mounting bracket having a mounting plate having a bore, a cantilever member pivotally mounted to said mounting bracket, cantilever member has a near end and a distal end and said cantilever member pivots nearer the near end than said distal end, said near end having an aperture and a lug rotatably received with said aperture, said lug having a threaded transverse bore, a foot pad mounted at the distal end of said cantilever member, and a screw extending through said bore of said mounting plate and having a nut threadingly engaged thereon for lightly clamping said mounting plate with a screw head of said screw, said screw threadably engaging said lug, whereby relative rotation of said screw pivots said cantilever member.

14. The adjustable foot assembly as claimed in claim 13 wherein said screw is mounted substantially tangential to the pivotal rotation of said cantilever member.

15. The adjustable foot assembly as claimed in claim 14 wherein said mounting bracket is hollow having an open end and said near end of said cantilever member is housed within said mounting bracket.

16. The adjustable foot assembly as claimed in claim 15 wherein said cantilever member has a length ratio of the distal end to pivot and the pivot to the near end of about 3:1.

17. The adjustable foot assembly as claimed in claim 16 wherein said foot pad has a pivoting base for compensating for a differences between relative angles between a support surface and said cantilever member.

18. Furniture comprising an adjustable foot assembly for supporting and levelling the furniture, said adjustable foot assembly comprising:

a mounting bracket having attachment means for attaching the mounting bracket to a frame of said furniture, said mounting bracket having a mounting plate having a bore, a cantilever member pivotally mounted to said mounting bracket, cantilever member has a near end and a distal end and said cantilever member pivots nearer the near end than said distal end, said near end having an aperture and a lug rotatably received with said aperture, said lug having a threaded transverse bore, a foot pad mounted at the distal end of said cantilever member, and a screw extending through said bore of said mounting plate and having a nut threadingly engaged thereon for lightly clamping said mounting plate with a screw head of said screw, said screw threadably engaging said lug, whereby relative rotation of said screw pivots said cantilever member.

19. The furniture as claimed in claim 18 where said adjustable foot assembly supports a desk top.

20. The furniture as claimed in claim 18 wherein said adjustable foot assembly stably supports said furniture.

* * * * *